US012584425B1

(12) United States Patent
Wallace, III

(10) Patent No.: US 12,584,425 B1
(45) Date of Patent: Mar. 24, 2026

(54) ENGINE VALVE CONTROL SYSTEM AND METHOD

(71) Applicant: William Clyde Wallace, III, Carson City, NV (US)

(72) Inventor: William Clyde Wallace, III, Carson City, NV (US)

( * ) Notice: Subject to any disclaimer, the term of this patent is extended or adjusted under 35 U.S.C. 154(b) by 0 days.

(21) Appl. No.: 19/363,296

(22) Filed: Oct. 20, 2025

(51) Int. Cl.

| | |
|---|---|
| ***F01L 1/46*** | (2006.01) |
| ***F01L 1/053*** | (2006.01) |
| ***F01L 1/08*** | (2006.01) |
| ***F01L 1/18*** | (2006.01) |
| ***F01L 13/00*** | (2006.01) |

(52) U.S. Cl.
CPC ..... *F01L 1/08* (2013.01); *F01L 1/053* (2013.01); *F01L 1/181* (2013.01); *F01L 1/462* (2013.01); *F01L 13/0036* (2013.01)

(58) Field of Classification Search
CPC ..... F01L 13/0036; F01L 1/462; F01L 1/08; F01L 1/181; F01L 1/053
See application file for complete search history.

(56) References Cited

U.S. PATENT DOCUMENTS

| | | | | |
|---|---|---|---|---|
| 4,723,515 A | | 2/1988 | Burandt | |
| 5,564,373 A | * | 10/1996 | Hara | F01L 1/267 123/90.21 |
| 6,311,659 B1 | | 11/2001 | Pierik | |
| 7,404,386 B1 | * | 7/2008 | Raghavan | F01L 13/0036 74/559 |
| 2001/0037782 A1 | | 11/2001 | Pierik | |
| 2008/0060594 A1 | | 3/2008 | Cline et al. | |
| 2008/0083386 A1 | | 4/2008 | Oh | |

FOREIGN PATENT DOCUMENTS

| | | | | |
|---|---|---|---|---|
| DE | 3512035 A1 | * | 11/1985 | F01L 1/12 |
| DE | 3503740 A1 | | 8/1986 | |
| DE | 102004009074 B3 | * | 7/2005 | F16H 53/00 |
| EP | 0091804 A1 | | 10/1983 | |

* cited by examiner

*Primary Examiner* — Ngoc T Nguyen
(74) *Attorney, Agent, or Firm* — Goodman Law Center, P.C.

(57) ABSTRACT

A system and method for controlling an engine valve in an internal combustion engine is disclosed. The system includes a valve spring supported on a spring base biasing an engine valve toward a closed position, and a camshaft having a center cam lobe and first and second outer cam lobes. In some embodiments, a center rocker arm is engaged with the center cam lobe and a valve stem of the engine valve, such that rotation of the camshaft displaces the engine valve to an open position. Further, in some embodiments, a lower rocker arm is engaged with the first and second outer cam lobes and contacts the spring base. The outer cam lobes are phased to displace the spring base as the valve opens and closes, thereby reducing valve spring compression during valve opening.

20 Claims, 9 Drawing Sheets

ENGINE VALVE CONTROL SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of internal combustion engines of existing art and more specifically relates to a three-lobed camshaft assembly for controlling valve spring compression.

RELATED ART

Internal combustion engines typically employ camshaft-driven valve actuation mechanisms to control the timing of intake and exhaust valve events. In conventional systems, each engine valve is biased toward a closed position by a valve spring. A camshaft, supported in the engine block or cylinder head, includes a plurality of cam lobes that impart lift to the valves through rocker arms, followers, or other actuation elements. As the camshaft rotates, the rising flank of each cam lobe displaces a corresponding valve against the force of its valve spring to open the valve, while the spring returns the valve to the closed position as the cam lobe rotates past its nose.

A problem in current valve actuation systems is the substantial horsepower and torque required to rotate the camshaft against high valve spring pressures. In a typical passenger vehicle engine, valve springs are installed at heights of about 1.5 inches and are compressed by roughly 0.5 inches during valve operation, producing closing forces in the range of 200 to 400 pounds. These loads not only increase the torque needed to drive the camshaft, but also translate into horsepower losses, accelerated wear of cam lobes and follower surfaces, and a heightened risk of valve float at elevated engine speeds.

Accordingly, there is a need for a valve actuation system that reduces the effective spring compression encountered during valve opening, thereby lowering camshaft torque demand and associated power loss, while maintaining reliable valve seating and preventing float at high RPM.

SUMMARY OF THE INVENTION

In view of the foregoing disadvantages inherent in the known internal combustion engine valve art, the present disclosure provides a novel engine valve control system and method. The general purpose of the present disclosure, which will be described subsequently in greater detail, is to provide a valve actuation and control system for an internal combustion engine that reduces valve spring compression during valve opening while maintaining reliable valve closure.

A system for controlling an engine valve in an internal combustion engine is disclosed herein, according to an embodiment of the present disclosure. The system may include a camshaft with three cam lobes disposed thereon and a valve spring biasing the engine valve toward a closed position. The three cam lobes may include a first outer cam lobe, a second outer cam lobe and a central cam lobe in between the first outer cam lobe and the second outer cam lobe. Rotation of the camshaft causes the central cam lobe to directly or indirectly engage the valve spring to move the engine valve into an open position. Further, the rotation of the camshaft causes the first and second outer cam lobes to directly or indirectly lower a spring base of the valve spring as the engine valve is moved into the open position, and raise the base of the valve spring as the engine valve is moved into the closed position.

According to another embodiment, a system may include a camshaft supported in a cylinder head of the internal combustion engine above the engine valve; three cam lobes disposed on the camshaft, the three cam lobes including a first outer cam lobe, a second outer cam lobe and a central cam lobe in between the first outer cam lobe and the second outer cam lobe; a valve spring biasing the engine valve toward a closed position; a central rocker arm including a first end having a roller follower in contact with the central cam lobe, a second end having a roller follower in contact with a valve stem of the engine valve and a pivot point for attaching the central rocker arm to a pivot shaft about which the center rock arm is configured to pivot; and a lower rocker arm including a first end, a second end and a pivot point attaching the lower rocker arm to the pivot shaft, about which the lower rocker arm is configured to pivot. The first end of the lower rocker arm may include a generally U-shaped configuration defining two rocker arm members, with each end of the two rocker arm members including a roller follower in contact with one of the first and second outer cam lobes, the second end of the lower rocker arm in contact with the spring base of the valve spring.

Rotation of the camshaft causes the central cam lobe to push the first end of the central rocker arm upward, moving the second end of the central rocker arm downward into a valve stem of the engine valve and moving the engine valve into the open position. As the engine valve is moved into the open position, further rotation of the camshaft causes the first and second outer cam lobes to displace the first end of the lower rocker arm upward, thereby moving the second end of the lower rocker arm downward and lowering the spring base of the valve spring. As the engine valve is moved into the closed position, further rotation of the camshaft causes the first and second outer cam lobes to move the first end of the lower rocker arm downward, thereby moving the second end of the lower rock arm upward and raising the spring base of the valve spring.

A method for controlling an engine valve in an internal combustion engine is disclosed herein, according to an embodiment of the present disclosure. The method may include providing a camshaft supported in a cylinder head of the internal combustion engine, the camshaft comprising three cam lobes disposed on the camshaft, the three cam lobes including a first outer cam lobe, a second outer cam lobe and a central cam lobe in between the first outer cam lobe and the second outer cam lobe; providing a valve spring biasing the engine valve toward a closed position; and causing rotation of the camshaft, thereby: causing the central cam lobe to directly or indirectly engage the valve spring to move the engine valve into an open position; causing the first and second outer cam lobes to directly or indirectly lower a spring base of the valve spring as the engine valve is moved into the open position; and causing the first and second outer cam lobes to directly or indirectly raise the spring base of the valve spring as the engine valve is moved into the closed position.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an engine valve control system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a camshaft assembly for an internal combustion chamber engine and more particularly to an engine valve control system and method. Generally, the engine valve control system and method provides a valve actuation system for an internal combustion engine that reduces valve spring compression during valve opening while maintaining reliable valve closure. In operation, a camshaft performs both the function of opening the valve through a center cam lobe and the function of controlling a spring base of a valve spring through outer lobes to aid in closing of the valve and reducing spring compression. As such, horsepower and torque required to turn a camshaft is virtually eliminated, along with potential valve float at high RPM. This leaves more net horsepower to move a vehicle, leading to better miles per gallon fuel use.

Referring now more specifically to the drawings by numerals of reference, there is shown in FIGS. 1-4, various views of a system 100 for controlling an engine valve 5 in an internal combustion engine 7. In some embodiments, the system 100 provides an overhead camshaft having multiple lobes configured to simultaneously actuate an engine valve 5 and control the compression of a valve spring 105 during opening and closing of the engine valve 5. The engine valve 5 can be an intake valve or an exhaust valve (or both).

Figure 1:
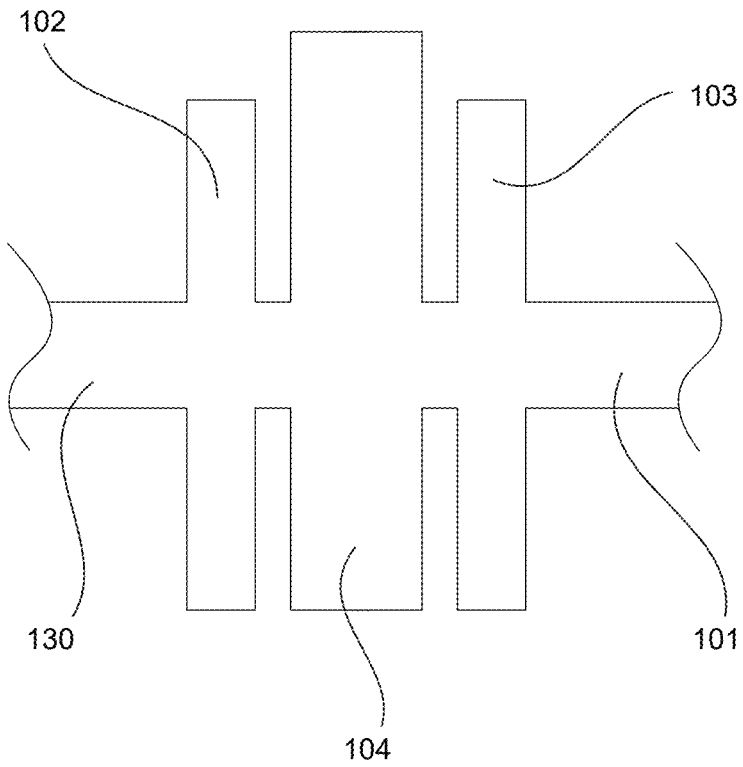
FIG. 1 is a front view of a camshaft having three cam lobes, according to an embodiment of the disclosure.
Figure 2:
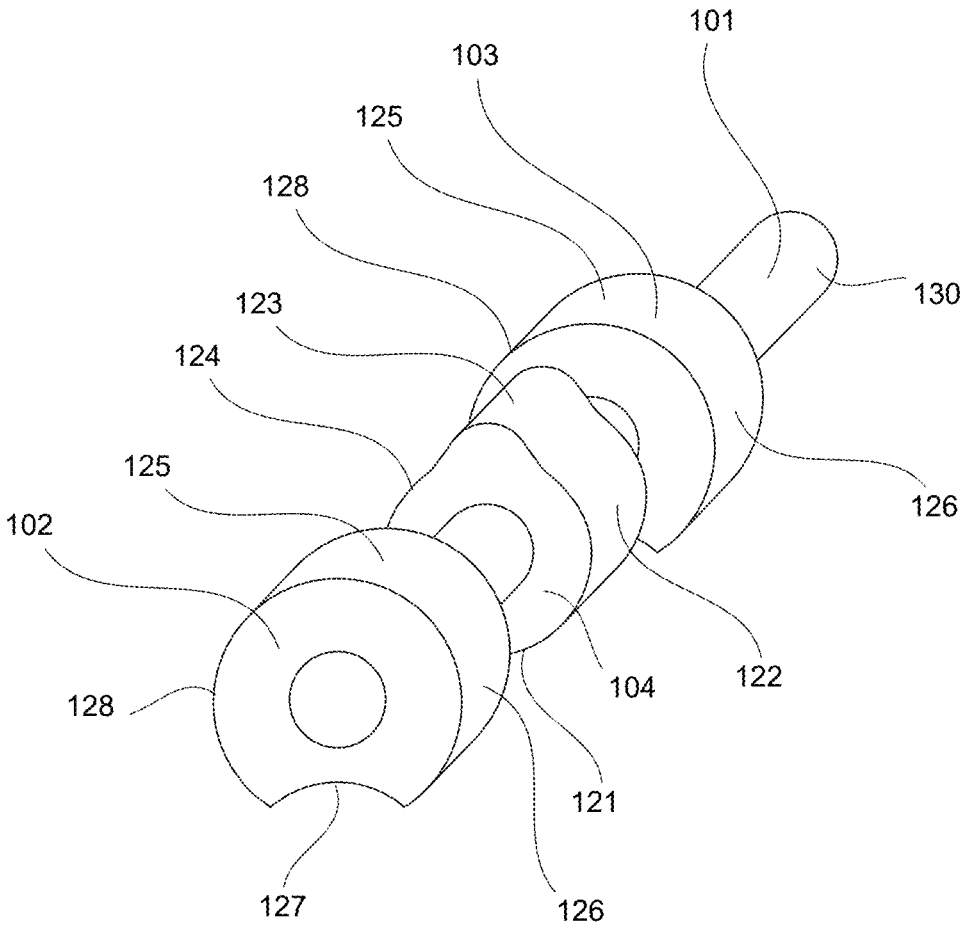
FIG. 2 is a perspective view of the camshaft having three cam lobes, according to an embodiment of the disclosure.

Beginning first with FIGS. 1-2, there is shown a front view of a camshaft 101 of the present invention, according to one or more embodiments thereof. The camshaft 101 may include an elongated length 130 defining a longitudinal, rotational axis and configured to rotate continuously whilst the engine 7 is running. Preferably, the camshaft 101 may be an overhead camshaft supported in a cylinder head 8 of the internal combustion engine 7 above the engine valve 5. As shown here, disposed on the camshaft 101 are three cam lobes-dissimilar to previous camshafts 101 of the prior art which include one cam lobe per valve. The three cam lobes may include a first outer cam lobe 102, a second outer cam lobe 103 and a central cam lobe 104 in between the first outer cam lobe 102 and the second outer cam lobe 103. It should be appreciated that the three cam lobes act on one engine valve 5, so there may be additional sets of three cam lobes 102, 103, 104 on the same camshaft 101 for operating other engine valves 5.

The central cam lobe 104 may include a same or similar configuration as cam lobes known in the prior art, such that the central cam lobe 104 may include an egg or teardrop-shape, having a base circle 121, an opening flank 122 leading away from the base circle 121, a nose 123 and a closing flank 124 returning back to the base circle 121.

Figure 3:
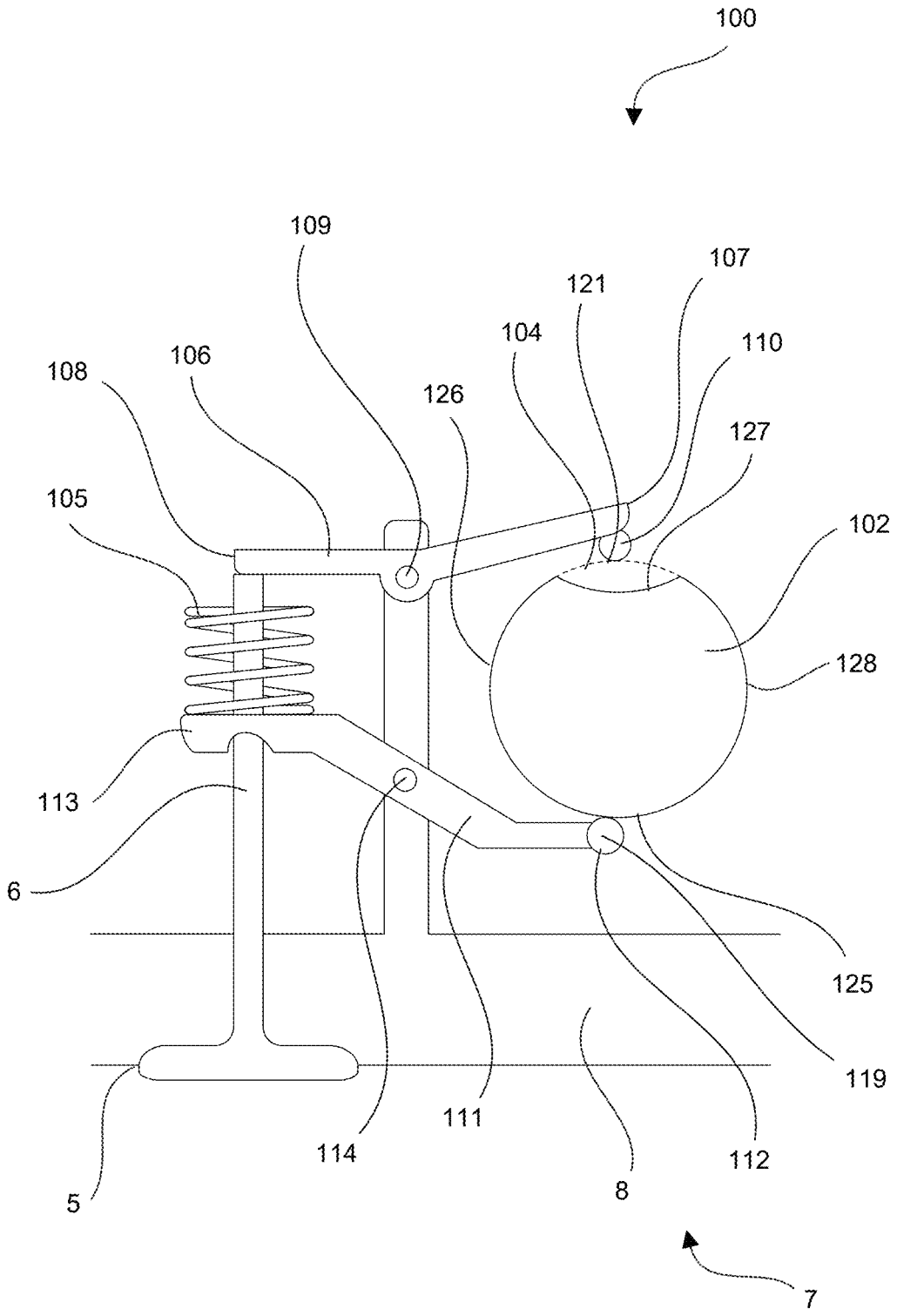
FIG. 3 is a diagram of a system for controlling an engine valve of an internal combustion engine, the system including the camshaft having three cam lobes, a central rocker arm, a lower rocker arm and a valve spring, with the engine valve in a closed position, according to an embodiment of the present disclosure.
Figure 4:
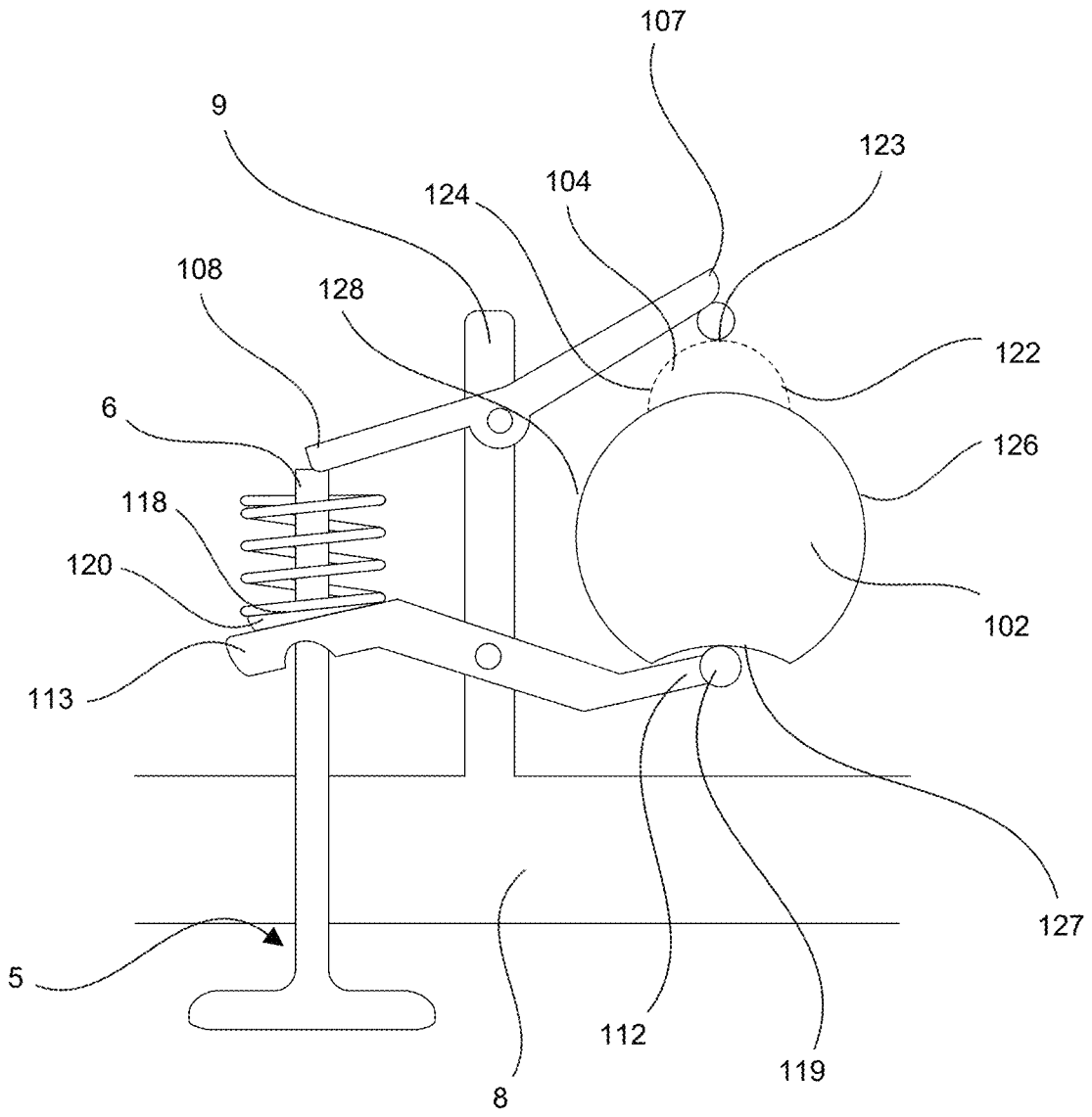
FIG. 4 is a diagram of the engine valve control system with the engine valve in an open position, according to an embodiment of the present disclosure.

Referring now also more particularly to FIGS. 3-4, there are shown two side views showing the system 100 during opening and closing of the engine valve 5 within the cylinder head 8. As shown in FIG. 3, a valve spring 105 biases the engine valve 5 toward a closed position. The camshaft 101 is configured to rotate about the rotational axis, rotating the three cam lobes such that the central cam lobe 104 is able to directly or indirectly cause the engine valve 5 to move into an open position and the first and second outer cam lobes 102, 103 are able to directly or indirectly control a spring base 118 of the valve spring 105, by lowering (during opening of the engine valve 5) or raising (during closing of the engine valve 5) the spring base 118.

Preferably, movement of the engine valve 5 into the open position begins before lowering of the spring base 118, and raising of the spring base 118 begins before movement of the engine valve 5 into the closed position. In other words, the valve lift imparted by the center cam lobe 104 is timed to begin slightly ahead of the first and second outer lobes 102, 103, while the first and second outer lobes 102, 103 are timed to begin spring base 118 raising slightly ahead of valve closing. As such, proper angular timing is maintained between the center cam lobe 104 and the first and second outer lobes 102, 103.

The phasing and control exhibited by the first and second outer cam lobes 102, 103 ensures the valve spring 105 maintains a closing force of approximately 100 lbs. to seal the valve properly, while limiting total compression. This may result in a spring compression of approximately 0.050 inches throughout the full cycle of valve opening and closing, as compared to conventional compression values of approximately 0.500 inches.

This reduced spring compression allows the use of a valve spring 105 having a significantly shorter installed height relative to prior art, while still ensuring a reliable valve seal at closure. For example, the valve spring 105 may include an installed height lesser than 1.5 inches. Because the spring forces that must be overcome during operation are substantially lowered, torque required to rotate the camshaft 101 is reduced, horsepower loss is minimized, and the risk of valve float is virtually eliminated. Further, the reduced loads permit narrower cam lobe widths, since wear factors associated with high spring forces are alleviated.

As above, the central cam lobe 104 may include a same or similar configuration as cam lobes in the prior art, such that the central cam lobe 104 includes an egg or teardrop-shape. As shown in FIGS. 2-4, the first and second outer cam lobes 102, 103 may be inverted, or at least substantially so. Further, as shown here, instead of a convex nose 123 as shown on the central cam lobe 104, the first and second outer cam lobes 102, 103 may include a concave portion 127 opposite a base circle 125, as well as a lowering flank 126 leading away from the base circle 125 and a raising flank 128 returning back to the base circle 125.

Figure 5:
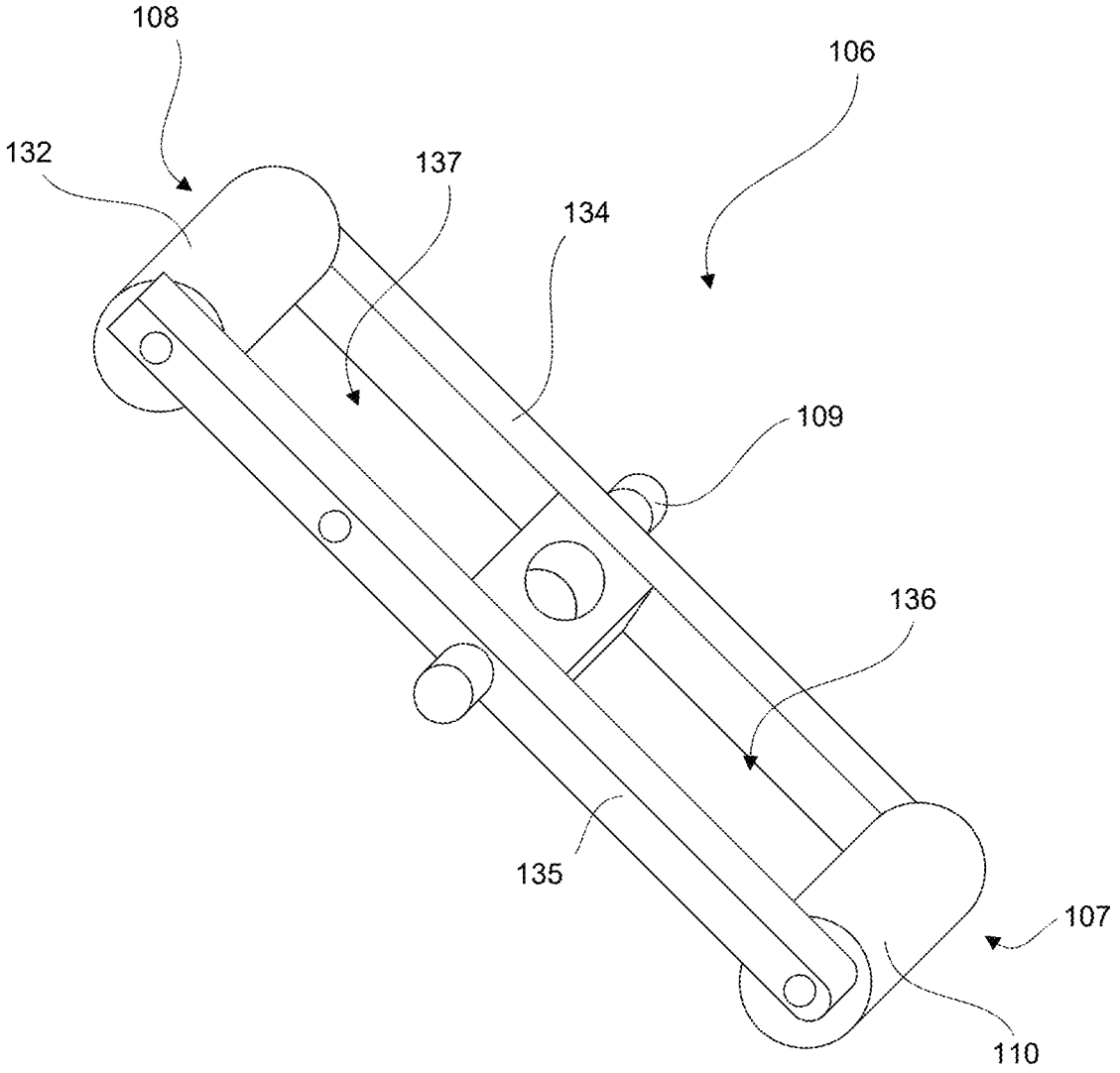
FIG. 5 is a perspective view of the central rocker arm of the engine valve control system, according to an embodiment of the present disclosure.

As demonstrated in FIGS. 3-4, and further referring to FIG. 5-8, the system 100 may further include a central rocker arm 106 and a lower rocker arm 111. The central rocker arm 106 may include a first end 107 in contact with the central cam lobe 104, a second end 108 in contact with a valve stem 6 of the valve spring 105, a pivot point 109 attaching the central rocker arm 106 to a pivot shaft 9, about which the center rock arm is configured to pivot, a first rocker side 134 and a second rocker side 135 defining a first rocker portion 136 between the pivot point 109 and the first end 107 and a second rocker portion 137 between the pivot point and the second end 108. As shown in FIG. 5, the pivot point 109 may include a pivot bearing. As such, in some embodiments, rotation of the camshaft 101 causes the central cam lobe 104 to push the first end 107 of the central rocker arm 106 upward, pushing the valve stem 6 downward via the second end 108 of the central rocker arm 106 and thereby moving the engine valve 5 into the open position.

The pushing of the first end 107 of the central rocker arm 106 may be achieved once the opening flank 122 of the central cam lobe 104 contacts the first end 107 of the central rocker arm 106, beginning opening of the engine valve 5, and the engine valve 5 is fully open once the nose 123 of the central cam lobe 104 contacts the first end 107 of the central rocker arm 106, fully pushing the valve stem 6 downward via the second end 108 of the central rocker arm 106. As shown best in FIGS. 4-5, the first end 107 of the central rocker arm 106 may include a roller follower 110 to contact the central cam lobe 104 and roll along a profile of the central cam lobe 104, reducing friction and wear; and the second end 108 of the central rocker arm 106 may include a roller follower 132 to contact the valve stem 6 of the engine valve 5.

Figure 6:
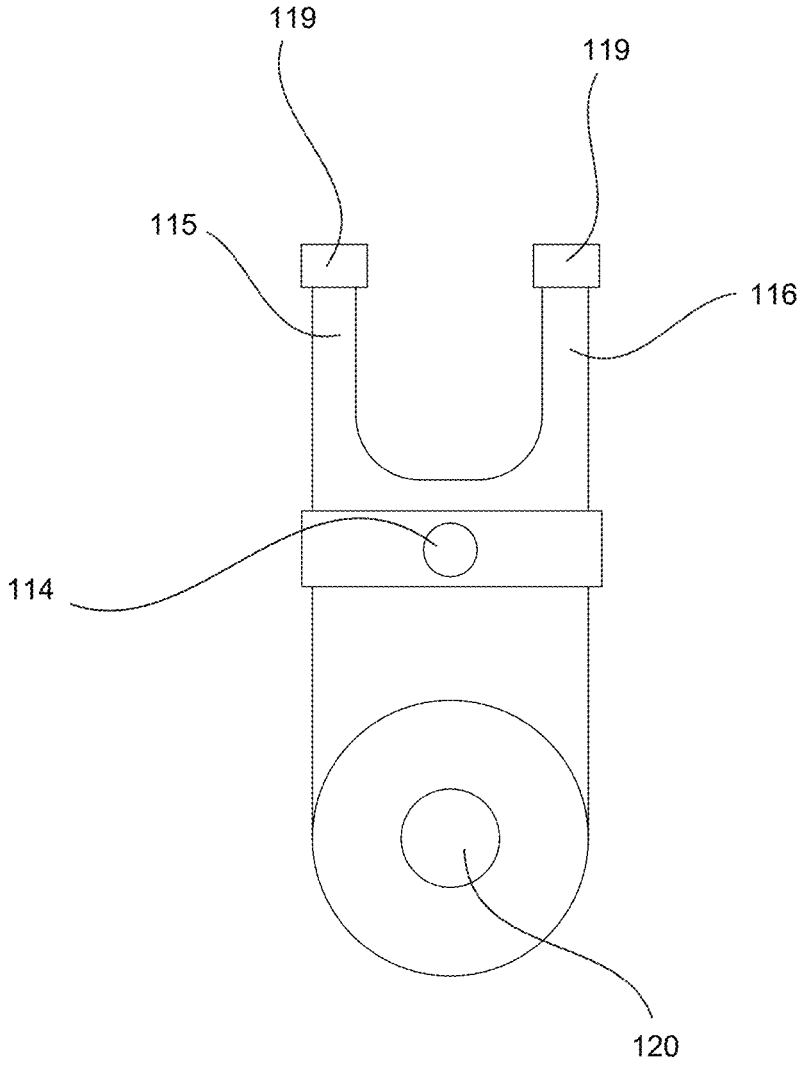
FIG. 6 is a top plan view of the lower rocker arm of the engine valve control system, according to an embodiment of the present disclosure.
Figure 7:
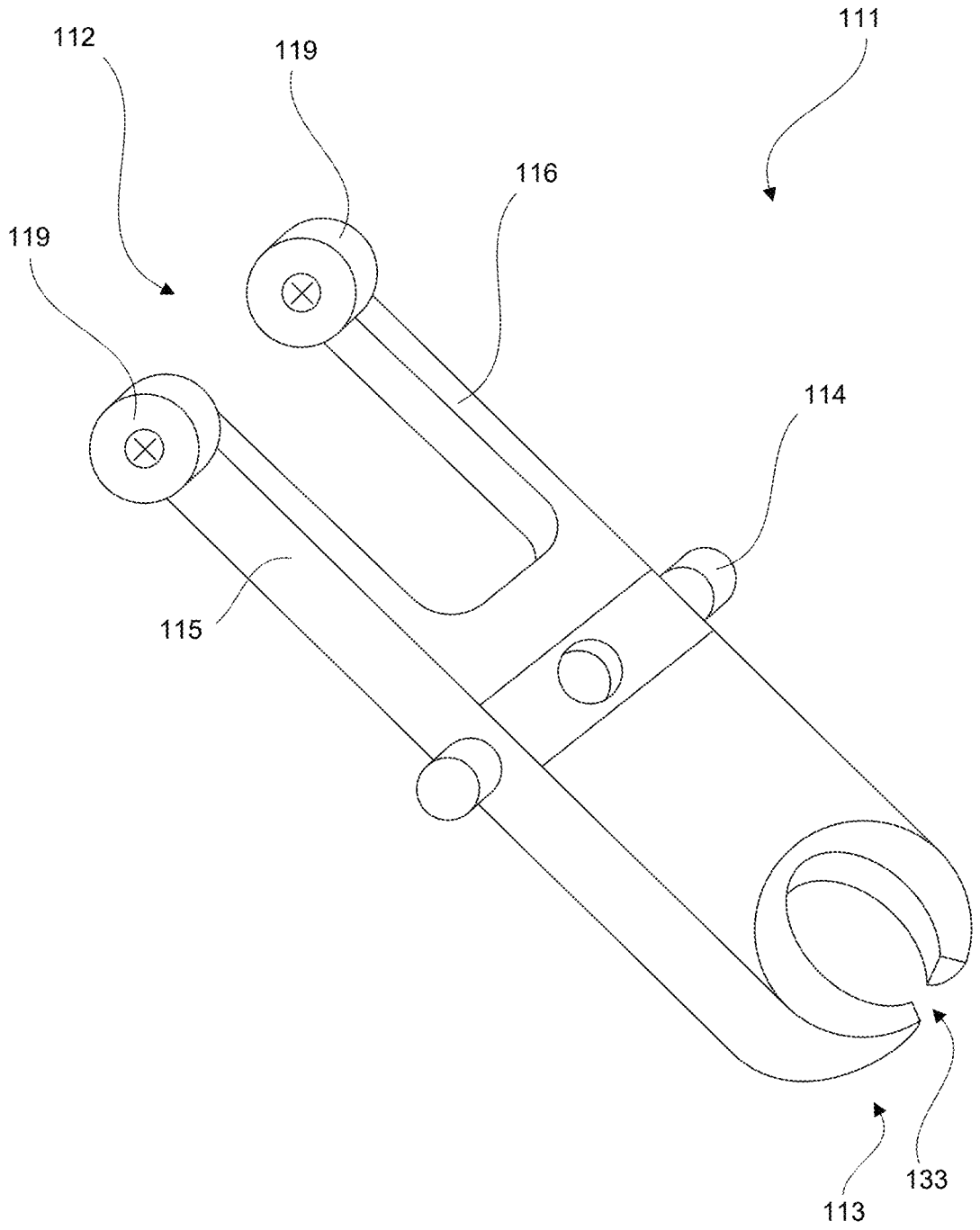
FIG. 7 is a perspective view of the lower rocker arm of the engine valve control system, according to an embodiment of the present disclosure.
Figure 8:
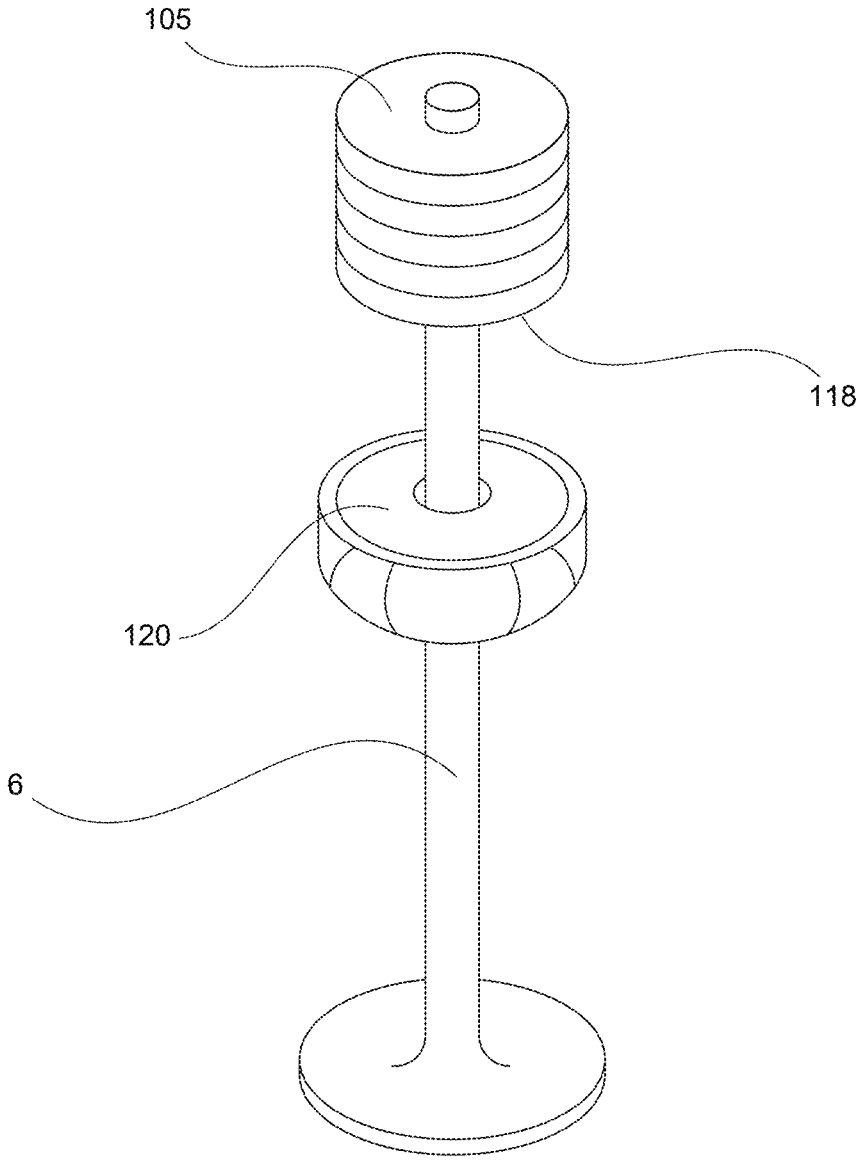
FIG. 8 is a perspective view of a valve stem, a ball joint and a valve spring with a spring base configured to contact the ball joint, according to an embodiment of the present disclosure.

FIGS. 6-7 shows a top plan view and a perspective view of the lower rocker arm 111, according to one or more embodiment of the present disclosure. As shown here, the lower rocker arm 111 may include a first end 112, a second end 113 and a pivot point 114 attaching the lower rocker arm 111 to a pivot shaft 9, about which the lower rocker arm 111 is configured to pivot. As shown in FIG. 7, the pivot point 114 may include a pivot bearing.

As shown particularly in FIGS. 6-7, the lower rocker arm 111 may include a generally U-shaped configuration defining two rocker arm members 115, 116 terminating at the first end 112 of the lower rocker arm 111—each end of the two rocker arm members 115, 116 are configured to contact one of the first and second outer cam lobe 102, 103 (e.g., the end of rocker arm 115 contacts the first outer cam lobe 102 and the end of rocker arm 116 contacts the second outer cam lobe 103). In some embodiments, each end of the two rocker arm members 115, 116 may include a roller follower 119 to contact the respective first and second outer cam lobes 102, 103 and roll along a profile thereof, again, reducing friction and wear.

As shown in FIG. 4, the second end 113 of the lower rocker arm 111 is in contact with the spring base 118 of the valve spring 105. For example, as shown in FIG. 4 and in FIG. 8, a ball joint 120 may be attached along the valve stem 6 beneath the spring base 118 to facilitate movement of the spring base 118 by the second end 113 of the lower rocker arm 111. As shown best in FIG. 7, the second end 113 of the lower rocker arm 111 may include a seat 133, or 'cup', for the ball joint 120 and/or spring base 118 to sit in. As such, in some embodiments, rotation of the camshaft 101 causes the first and second outer cam lobes 102, 103 to move the first end 112 of the lower rocker arm 111 upward, causing the second end 113 of the lower rocker arm 111 to move the spring base 118 of the valve spring 105 downward as the engine valve 5 is moved into the open position; and further rotation causes the first and second outer cam lobes 102, 103 to move the first end 112 of the lower rocker arm 111 downward, causing the second end 113 of the lower rocker arm 111 to move the spring base 118 of the valve spring 105 upward as the engine valve 5 is moved into the closed position.

This is possible due to the shape of the first and second outer cam lobes 102, 103. In particular, as shown in FIG. 3, when the engine valve 5 is closed, the base circle 125 of the first and second outer cam lobes 102, 103 are pushing the first end 112 of the lower rocker arm 111 downward, which keeps the second end 113 of the lower rocker arm 111 in a normal position, whereby the valve spring 105 is in a normal position, biasing the engine valve 5 into the closed position. Once the central cam lobe 104 rotates such that the nose 123 of the central cam lobe 104 pushes the first end 107 of the central rocker arm 106 upward, moving the second end 108 downward and pushing the valve stem 6 down to move the engine valve 5 into the open position, the concave portion 127 of the first and second outer cam lobes 102, 103 contacts the ends of the two rocker arm members 115, 116, which causes displacement of the first end 112 of the lower rocker arm 111 upward, and brings the second end 113 of the lower rocker arm 111 downward, thereby lowering the spring base 118 of the valve spring 105 and reducing normal compression that would happen in prior art systems to the valve spring 105.

As above, the valve lift imparted by the center cam lobe 104 is timed to begin slightly ahead of the first and second outer lobes 102, 103, while the first and second outer lobes 102, 103 are timed to begin spring base 118 raising slightly ahead of valve closing. In particular, in some embodiments, the first and second outer cam lobes 102, 103 are arranged relative to the central cam lobe 104 such that the rotation of the camshaft 101 moves the opening flank 122 of the central cam lobe 104 into contact with a first end 107 of the central rocker arm 106, which begins moving the engine valve 5 into the open position, slightly before moving the lowering flank 128 of the first and second outer cam lobes 102, 103 into contact with the first end 112 of the lower rocker arm 111. Here, the engine valve 5 reaches the open position once the nose 123 of the central cam lobe 104 is in contact with the first end 107 of the central rocker arm 106 and the spring base 118 is fully lowered once the concave portion 127 of the first and second outer cam lobes 102, 103 is in contact with the first end 112 of the lower rocker arm 111.

Further rotation of the camshaft 101 moves the raising flank 126 of the first and second outer cam lobes 102, 103 into contact with the first end 112 of the lower rocker arm 111, slightly before moving the closing flank 124 of the central cam lobe 104 into contact with the first end 107 of the central rocker arm 106, which begins moving the engine valve 5 into the closed position. Here, the spring base 118 is fully raised once the base circle 125 is in contact with the first end 112 of the lower rocker arm 111 and the engine valve 5 reaches the closed position once the base circle 121 of the central cam lobe 104 is in contact with the first end 107 of the central rocker arm 106. The step timing between the central and lower rocker arms 106, 111 is critical to ensure the central cam lobe 104 is in total control of opening and closing of the engine valve 5.

Figure 9:
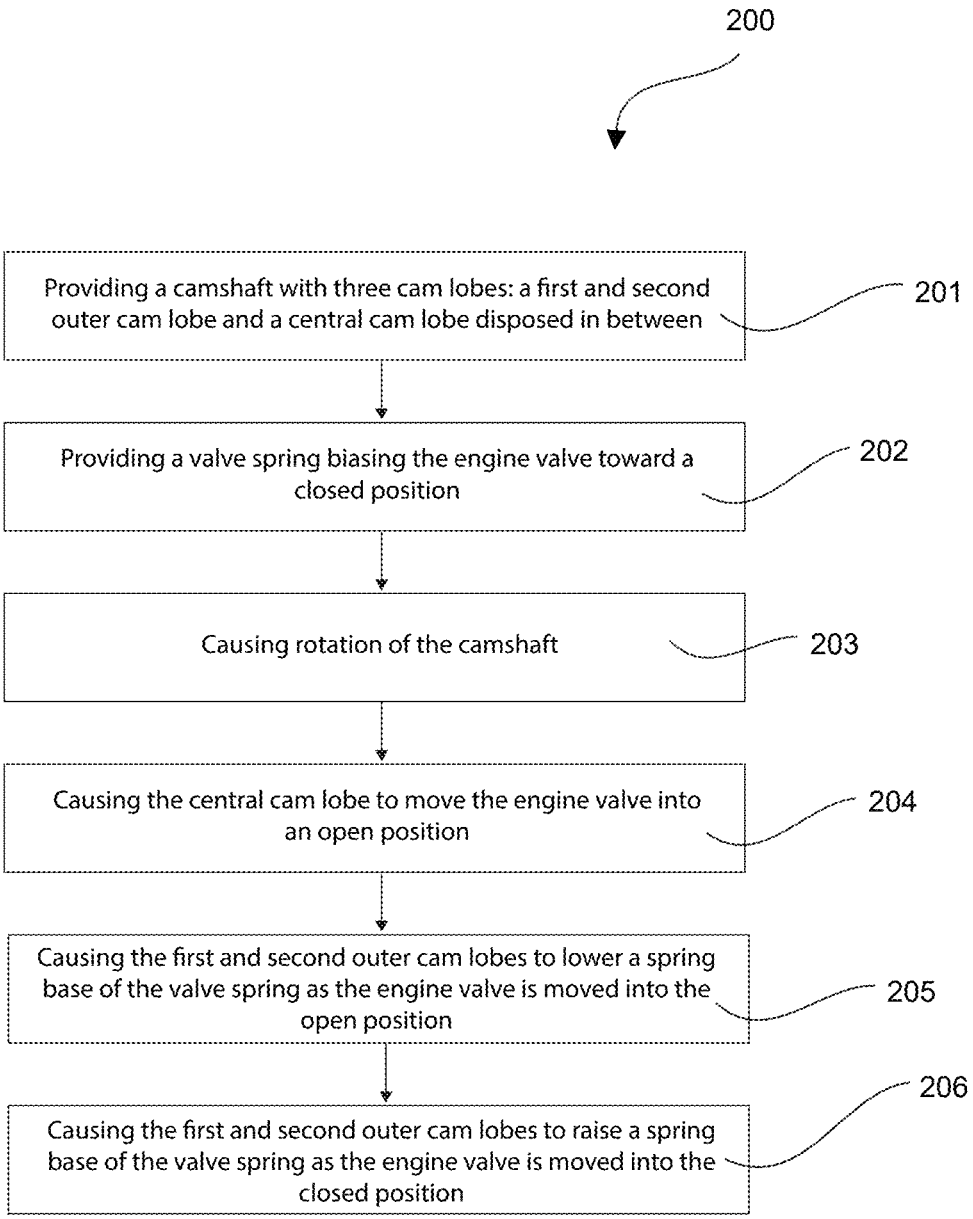
FIG. 9 is a flow diagram illustrating a method for controlling an engine valve of an internal combustion engine, according to an embodiment of the present disclosure.

Referring now to FIG. 9 showing a flow diagram illustrating a method 200 for controlling an engine valve 5 in an internal combustion engine 7, according to an embodiment of the present disclosure. In particular, the method 200 may include one or more components or features of the system 100 as described above. As illustrated, the method 200 may include the steps of: step one 201, providing a camshaft supported in a cylinder head of the internal combustion engine, the camshaft comprising three cam lobes disposed on the camshaft, the three cam lobes including a first outer cam lobe, a second outer cam lobe and a central cam lobe in between the first outer cam lobe and the second outer cam lobe; step two 202, providing a valve spring biasing the engine valve toward a closed position; step three 203, causing rotation of the camshaft, thereby: causing 204 the central cam lobe to directly or indirectly engage the valve spring to move the engine valve into an open position; causing 205 the first and second outer cam lobes to directly or indirectly lower a spring base of the valve spring as the engine valve is moved into the open position; and causing 206 the first and second outer cam lobes to directly or indirectly raise the spring base of the of the valve spring as the engine valve is moved into the closed position.

The use of "step of" should not be interpreted as "step for", in the claims herein and is not intended to invoke the provisions of 35 U.S.C. § 112 (f). It should also be noted that, under appropriate circumstances, considering such issues as design preference, user preferences, marketing preferences, cost, structural requirements, available materials, technological advances, etc., other methods are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A system for controlling an engine valve in an internal combustion engine, the system comprising:

a. a camshaft;

b. three cam lobes disposed on the camshaft, the three cam lobes including:

i. a first outer cam lobe;

ii. a second outer cam lobe; and iii. a central cam lobe in between the first outer cam lobe and the second outer cam lobe; and c. a valve spring biasing the engine valve toward a closed position;

d. wherein rotation of the camshaft causes the central cam lobe to directly or indirectly engage the valve spring to move the engine valve into an open position; and e. further causes the first and second outer cam lobes to directly or indirectly lower a spring base of the valve spring as the engine valve is moved into the open position, and raise the base of the valve spring as the engine valve is moved into the closed position.

2. The system of claim 1, wherein the camshaft is an overhead camshaft supported in a cylinder head of the internal combustion engine above the engine valve.

3. The system of claim 1, wherein the valve spring has an installed height lesser than 1.5 inches.

4. The system of claim 1, wherein the valve spring undergoes a compression of approximately 0.050 inches during a full cycle of valve opening and closing.

5. The system of claim 1, further comprising a central rocker arm including a first end configured for contact with the central cam lobe, a second end in contact with a valve stem of the engine valve and a pivot point for attaching the central rocker arm to a pivot shaft, about which the center rock arm is configured to pivot, such that rotation of the camshaft causes the central cam lobe to push the first end of the central rocker arm upward, moving the second end of the central rocker arm downward into the valve stem and moving the engine valve into the open position.

6. The system of claim 5, wherein the first end and the second end of the central rocker arm each include a roller follower.

7. The system of claim 1, further comprising a lower rocker arm including a first end, a second end and a pivot point for attaching the lower rocker arm to a pivot shaft, about which the lower rocker arm is configured to pivot.

8. The system of claim 7, wherein the lower rocker arm includes a generally U-shaped configuration defining two rocker arm members terminating at the first end of the lower rocker arm, each end of the two rocker arm members configured for contact with one of the first and second outer cam lobes, wherein the second end of the lower rocker arm is in contact with the spring base of the valve spring, and wherein rotation of the camshaft as the engine valve is moved into the open position causes the first and second outer cam lobes to displace the first end of the lower rocker arm upward, thereby moving the second end of the lower rocker arm downward and lowering the spring base of the valve spring, and as the engine valve is moved into the closed position, rotation of the camshaft causes the first and second outer cam lobes to move the first end of the lower rocker arm downward, thereby moving the second end of the lower rock arm upward and raising the spring base of the valve spring.

9. The system of claim 8, wherein each said end of the two rocker arm members include a roller follower.

10. The system of claim 8, further comprising a ball joint attached along the valve stem beneath the spring base, the ball joint facilitating movement of the spring base via the second end of the lower rocker arm.

11. The system of claim 1, wherein the central cam lobe includes a base circle, an opening flank leading away from the base circle, a nose, and a closing flank returning back to the base circle.

12. The system of claim 11, wherein the first and second outer cam lobes each include a base circle, a raising flank leading away from the base circle, a concave portion, and a lowering flank returning back to the base circle.

13. The system of claim 12, wherein the first and second outer cam lobes are arranged relative to the central cam lobe such that the rotation of the camshaft:

a. moves the opening flank of the central cam lobe into contact with the first end of the central rocker arm, which begins moving the engine valve into the open position, slightly before moving the lowering flank of the first and second outer cam lobes into contact with the first end of the lower rocker arm, the engine valve reaching the open position once the nose of the central cam lobe is in contact with the first end of the central rocker arm and the spring base being fully lowered once the concave portion of the first and second outer cam lobes is in contact with the first end of the lower rocker arm; and b. moves the raising flank of the first and second outer cam lobes into contact with the first end of the lower rocker arm, slightly before moving the closing flank of the central cam lobe into contact with the first end of the central rocker arm, which begins moving the engine valve into the closed position, the spring base being fully raised once a base circle of the first and second outer cam lobes is in contact with the first end of the lower rocker arm and the engine valve reaching the closed position once the base circle of the central cam lobe is in contact with the first end of the central rocker arm.

14. A system for controlling an engine valve in an internal combustion engine, the system comprising:

a. a camshaft supported in a cylinder head of the internal combustion engine above the engine valve;

b. three cam lobes disposed on the camshaft, the three cam lobes including a first outer cam lobe, a second outer cam lobe and a central cam lobe in between the first outer cam lobe and the second outer cam lobe;

c. a valve spring biasing the engine valve toward a closed position;

d. a central rocker arm including a first end having a roller follower in contact with the central cam lobe, a second end having a roller follower in contact with a valve stem of the engine valve, and a pivot point for attaching the central rocker arm to a pivot shaft about which the center rock arm is configured to pivot; and e. a lower rocker arm including a first end, a second end and a pivot point attaching the lower rocker arm to the pivot shaft, about which the lower rocker arm is configured to pivot, the first end of the lower rocker arm including a generally U-shaped configuration defining two rocker arm members, each end of the two rocker arm members including a roller follower in contact with one of the first and second outer cam lobes, the second end of the lower rocker arm in contact with the spring base of the valve spring;

f. wherein rotation of the camshaft causes the central cam lobe to push the first end of the central rocker arm upward, moving the second end of the central rocker arm downward into a valve stem of the engine valve and moving the engine valve into the open position;

g. as the engine valve is moved into the open position, further causes the first and second outer cam lobes to displace the first end of the lower rocker arm upward, thereby moving the second end of the lower rocker arm downward and lowering the spring base of the valve spring; and h. as the engine valve is moved into the closed position, further causes the first and second outer cam lobes to move the first end of the lower rocker arm downward, thereby moving the second end of the lower rock arm upward and raising the spring base of the valve spring.

15. The system of claim 14, wherein the central cam lobe includes a base circle, an opening flank leading away from the base circle, a nose, and a closing flank returning back to the base circle, and wherein the first and second outer cam lobes each include a base circle, a raising flank leading away from the base circle, a concave portion, and a lowering flank returning back to the base circle.

16. The system of claim 15, wherein the first and second outer cam lobes are arranged relative to the central cam lobe such that the rotation of the camshaft:

a. moves the opening flank of the central cam lobe into contact with the first end of the central rocker arm, which begins moving the engine valve into the open position, slightly before moving the lowering flank of the first and second outer cam lobes into contact with the first end of the lower rocker arm, the engine valve reaching the open position once the nose of the central cam lobe is in contact with the first end of the central rocker arm and the spring base being fully lowered once the concave portion of the first and second outer cam lobes is in contact with the first end of the lower rocker arm; and b. moves the raising flank of the first and second outer cam lobes into contact with the first end of the lower rocker arm, slightly before moving the closing flank of the central cam lobe into contact with the first end of the central rocker arm, which begins moving the engine valve into the closed position, the spring base being fully raised once a base circle of the first and second outer cam lobes is in contact with the first end of the lower rocker arm and the engine valve reaching the closed position once the base circle of the central cam lobe is in contact with the first end of the central rocker arm.

17. A method for controlling an engine valve in an internal combustion engine, the method comprising the steps of:

a. providing a camshaft supported in a cylinder head of the internal combustion engine, the camshaft comprising three cam lobes disposed on the camshaft, the three cam lobes including a first outer cam lobe, a second outer cam lobe and a central cam lobe in between the first outer cam lobe and the second outer cam lobe;

b. providing a valve spring biasing the engine valve toward a closed position; and c. causing rotation of the camshaft, thereby:

i. causing the central cam lobe to directly or indirectly engage the valve spring to move the engine valve into an open position;

ii. causing the first and second outer cam lobes to directly or indirectly lower a spring base of the valve spring as the engine valve is moved into the open position; and iii. causing the first and second outer cam lobes to directly or indirectly raise the spring base of the valve spring as the engine valve is moved into the closed position.

18. The method of claim 17, further comprising the steps of:

a. providing a central rocker arm including a first end in contact with the central cam lobe, a second end in contact with a valve stem of the engine valve, and a pivot point for attaching the central rocker arm to a pivot shaft about which the center rock arm is configured to pivot; and b. wherein the step of causing the rotation of the camshaft causes the central cam lobe to push the first end of the central rocker arm upward, moving the second end of the central rocker arm downward into the valve stem and moving the engine valve into the open position.

19. The method of claim 18, further comprising the steps of:

a. providing a lower rocker arm including a first end, a second end and a pivot point attaching the lower rocker arm to a pivot shaft, about which the lower rocker arm is configured to pivot, the first end of the lower rocker arm includes a generally u-shaped configuration defining two rocker arm members, each of the two rocker arm members in contact with one of the first and second outer cam lobes, wherein the second end of the lower rocker arm is in contact with the spring base of the valve spring; and b. wherein the step of causing the rotation of the camshaft causes, as the engine valve is moved into the open position, the first and second outer cam lobes to displace the first end of the lower rocker arm upward, thereby moving the second end of the lower rocker arm downward and lowering the spring base of the valve spring, and as the engine valve is moved into the closed position, causes the first and second outer cam lobes to move the first end of the lower rocker arm downward, thereby moving the second end of the lower rock arm upward and raising the spring base of the valve spring.

20. The method of claim 19, wherein the first and second outer cam lobes are arranged relative to the central cam lobe such that the step of causing rotation of the camshaft:

a. moves an opening flank of the central cam lobe into contact with the first end of the central rocker arm, which begins moving the engine valve into the open position, slightly before moving a lowering flank of the first and second outer cam lobes into contact with the first end of the lower rocker arm, the engine valve reaching the open position once a nose of the central cam lobe is in contact with the first end of the central rocker arm and the spring base being fully lowered once a concave portion of the first and second outer cam lobes is in contact with the first end of the lower rocker arm; and b. moves a raising flank of the first and second outer cam lobes into contact with the first end of the lower rocker arm, slightly before moving a closing flank of the central cam lobe into contact with the first end of the central rocker arm, which begins moving the engine valve into the closed position, the spring base being fully raised once a base circle of the first and second outer cam lobes is in contact with the first end of the lower rocker arm and the engine valve reaching the closed position once a base circle of the central cam lobe is in contact with the first end.

* * * * *